US005529030A

United States Patent [19]

Rose

[11] Patent Number: 5,529,030

[45] **Date of Patent: * Jun. 25, 1996**

[54] FLUID ACTUATORS

[76] Inventor: Nigel E. Rose, 5 Woodvale Dr., Mugeeraba, Queensland, Australia, 4213

[ * ] Notice: The portion of the term of this patent subsequent to Feb. 22, 2011, has been disclaimed.

[21] Appl. No.: 198,968

[22] Filed: Feb. 18, 1994

Related U.S. Application Data

[63] Continuation-in-part of Ser. No. 835,911, Feb. 26, 1992, Pat. No. 5,287,829.

[51] Int. Cl.[6] ..... F01L 9/02

[52] U.S. Cl. ..... 123/90.12

[58] Field of Search ..... 123/90.12, 90.11, 123/90.13, 90.14, 197.1, 197.3, 197.4; 251/30.01, 30.04, 63.5; 91/329, 395; 92/175; 239/533.3, 533.8, 585.1

[56] References Cited

U.S. PATENT DOCUMENTS

| | | | |
|---|---|---|---|
| 3,844,528 | 10/1974 | Massie | 251/30.04 |
| 4,009,694 | 3/1977 | Firey | 123/90.12 |
| 4,293,287 | 10/1981 | Carrens | 91/329 |
| 4,767,282 | 8/1988 | Igarashi et al. | 91/329 |
| 4,830,331 | 5/1989 | Vindum | 251/63.5 |
| 4,974,495 | 12/1990 | Richeson, Jr. | 123/90.12 |
| 5,022,358 | 6/1991 | Richeson | 123/90.12 |
| 5,224,683 | 7/1993 | Richeson | 123/90.12 |
| 5,248,123 | 9/1993 | Richeson et al. | 123/90.12 |
| 5,253,619 | 10/1993 | Richeson et al. | 123/90.12 |
| 5,287,829 | 2/1994 | Rose | 123/90.12 |

FOREIGN PATENT DOCUMENTS 448755 4/1968 Switzerland .

*Primary Examiner*—Weilun Lo
*Attorney, Agent, or Firm*—Bauer & Schaffer

[57] ABSTRACT

A fluid actuated engine valve assembly comprising a fluid actuator (10) including a chamber (14) in which a piston assembly (17) reciprocates. The piston assembly (17) includes a pair of spaced pistons (18,19) which divide the chamber (12) into three sections (20 21,22) and a passageway (29) which supports a slide valve member (30). Movement of the slide valve member (30) in one direction causes fluid to be directed to the chamber section (20) to cause movement of the piston assembly (14) in one direction. Movement of the valve member (30) in the opposite direction vents the chamber (20) and permits spring (34) and/or spring (42) to move the piston assembly 17 in the opposite direction.

16 Claims, 7 Drawing Sheets

30
36
35
14
26
19
23
11

36
25
20
17
24
34
22
14
39
11
18
35
26
32
24
34
22
40

30
17
32
37
30

30
36
35
20
25
26
21
22
34
39

30
11

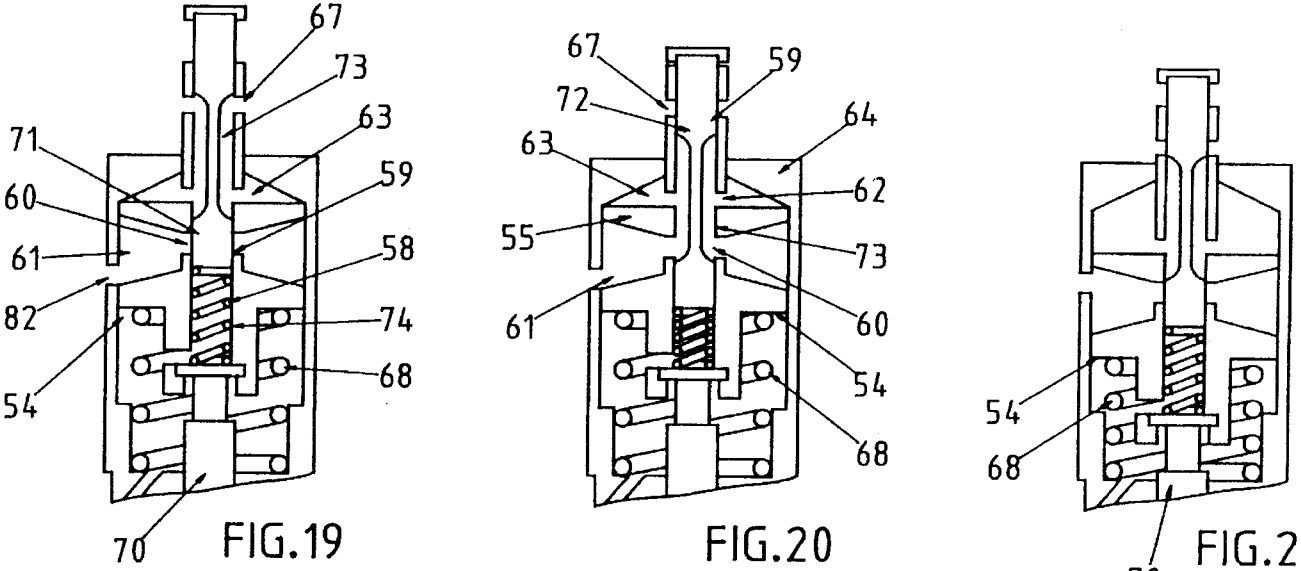
FIG.19
FIG.20
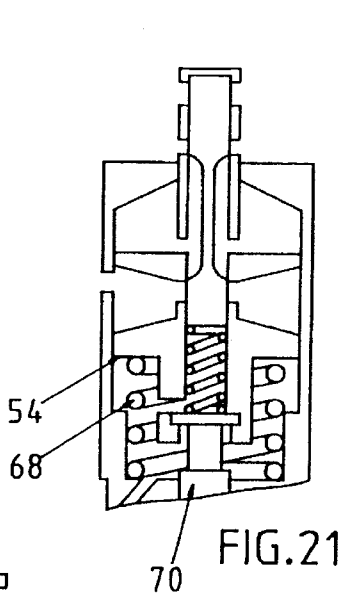
FIG.21
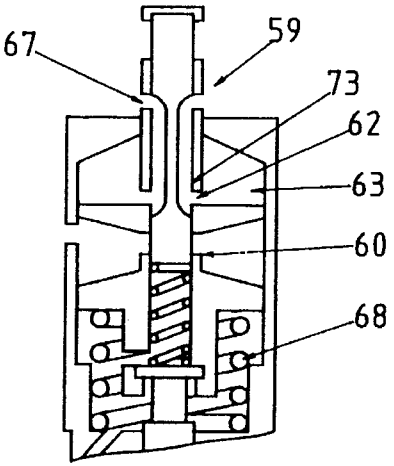
FIG.22
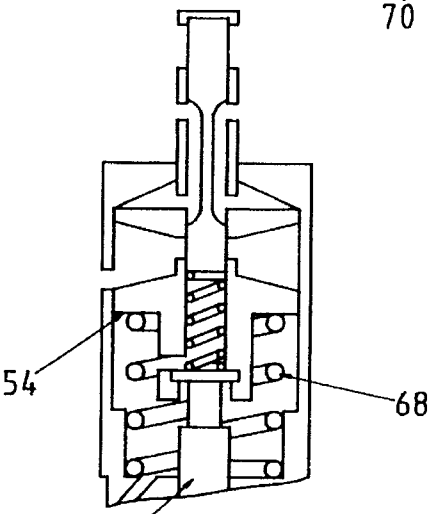
FIG.23

FLUID ACTUATORS

CROSS REFERENCE TO RELATED APPLICATION

This application is a continuation-in-part of application Ser. No. 07/835,911 filed Feb. 26, 1992, now U.S. Pat. No. 5,287,829.

TECHNICAL FIELD

This Invention relates to fluid actuators which in one particular aspect are applicable to the control of various mechanisms in internal combustion engines, for example exhaust and inlet valves or fuel injectors.

Background Art

Conventional internal combustion engines are provided with a number of different operating mechanisms for controlling inlet and outlet valves for the engine cylinders or in the case of fuel injected engines for controlling the injectors. Usually such mechanisms take the form of cam shafts, rockers, return springs or other mechanical actuating elements. Such mechanism suffer a number of disadvantages and limitations including in the case of valved engines poor valve cooling, poor lubrication, a lack of ability to maintain alignment of the valves with their seats, poor control over movement of the valve and an excessive amount of power which is required to overcome the valve seating springs.

Particular disadvantages associated with fuel injectors include lack of flexibility of injection timing, excessive mechanical components in the injector drive train, an excessive amount of power wastage in operating the injectors and their drive train and a lack of ease of assembly and removability of the injectors and associated drive train from the engine during maintenance.

Summary of the Invention

The present invention aims to provide a fluid actuator which may be applied to the many different applications where accurate control of movement is required. In one application, the fluid actuator of the invention may be used for the control of the inlet and exhaust valves of internal combustion engines so as to give increased control over movement of the valve and allowing for variable timing of the valve operating cycle. The present invention also aims to provide an arrangement which in the latter application reduces the reciprocating mass of the valve operating mechanism and reduces the rate of wear of the valve and its guides whilst increasing valve cooling and obtaining improved control over valve alignment with their seats. The present invention also aims to provide an actuator which when applied to the operation of fuel injectors enables simple control of injection timing, reduces the mass of injector drive train, which decreases the power required to operate the injectors and improves ease of assembly and disassembly of the injectors and their drive train to and from the engine.

With the above and other objects in view the present invention provides a fluid actuator including a chamber, a piston assembly arranged for reciprocating movement within said chamber, said piston assembly including first and second spaced apart pistons dividing said chamber into a first chamber section between said first piston and said chamber and a second chamber section between said first and second pistons, passageway means in said piston assembly, fluid inlet means communicating with said second chamber section and valve means for controlling the flow of fluid through said passageway means, said valve means being operable to communicate fluid through said passageway means from said second to said first chamber section so as to cause movement of said piston assembly in a first direction, biasing means for opposing movement of said piston assembly in said first direction, said valve means being further operable to vent fluid from said first chamber section whereby to permit said biasing means to move said piston assembly in a direction opposite said first direction. The biasing means suitably comprises spring biasing means and most preferably a coil spring or springs.

Most preferably, said piston assembly includes first and second port means communicating with said first and second chamber sections respectively and said valve means controls communication between said port means and said passageway means. The piston assembly suitably includes a portion extending beyond an end of the chamber, and vent port means in said extending portion and adapted for communication with said passageway means, said valve means being adapted to control communication of said vent port means with said first port means whereby to control venting of said first chamber sections.

Preferably, said passageway extends longitudinally of said piston assembly and said valve means is slidable in said passageway. Suitably, said valve means includes a plurality of lands, said lands being adapted to open and close said port means to control communication thereof with said passageway. Preferably, said lands are separated by annular grooves defining fluid paths in said passageway.

Means are suitably provided for reciprocating said valve means such that movement of said valve means in said first direction opens communication between said first and second port means and said passageway, to cause said movement of said piston assembly in said first direction.

Preferably, movement of said valve means in said opposite direction opens communication between said first port means and vent port means through said passageway to permit movement of said piston assembly under the influence of said biasing means in said opposite direction.

The actuator may also include further chamber sections communicating with the vent port means for isolating vented fluid.

Suitably, said biasing means acts on said second piston and comprises spring means disposed between said second piston and the other end of said chamber remote from the first chamber section. Alternatively, or additionally the biasing means comprises spring means externally of the chamber and acting on the piston assembly to oppose movement of the piston assembly in the first direction.

The present invention also provides the combination of a fluid actuator as described above and a valve of an internal combustion engine, said piston assembly of said actuator being coupled to said engine valve and wherein operation of said valve means is adapted to cause opening and closing movement of said engine valve. Suitably, said engine valve includes a valve stem, said piston assembly being secured to or formed integrally with said stem and said passageway being disposed within said stem.

The present invention further provides the combination of a fluid actuator as described above and a fuel injector having a reciprocatory plunger, said piston assembly of said actuator being coupled to said plunger and being adapted to reciprocate said plunger upon operation of said valve means.

BRIEF DESCRIPTION OF THE DRAWINGS

Reference will now be made to the accompanying drawings which illustrate a preferred embodiment of the invention and wherein:

FIGS. 19 to 23 illustrate the cycle of operation of the actuator as applied to fuel injectors.

BEST MODE FOR CARRYING OUT THE INVENTION

Figure 1:
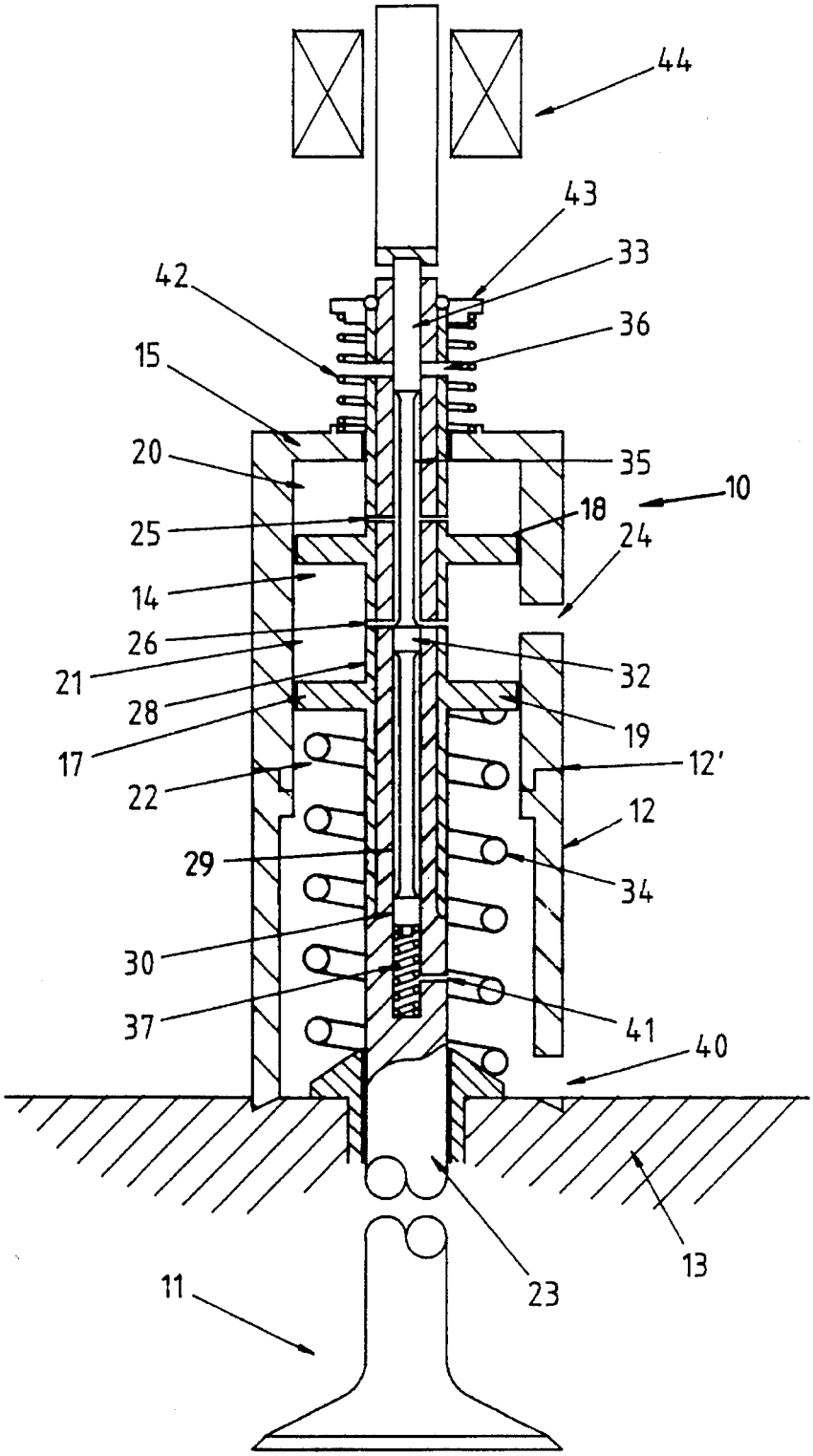
FIG. 1 is a somewhat pictorial longitudinal sectional view of a fluid actuator according to the present invention applied to the control of inlet or outlet valves of an internal combustion engine.

Referring to the drawings and firstly to FIG. 1 there is illustrated a fluid actuator 10 according to the present invention adapted for the control of a valve 11 of an internal combustion engine, for example an inlet or exhaust valve. The actuator 10 includes a housing 12 of generally cylindrical form which is mounted to the head 13 of an engine and which includes a cylindrical chamber 14 defined between an end wall 15 of the housing 12 and the head 13.

Arranged for reciprocation within the chamber 14 is a piston assembly 17 which includes a pair of spaced apart annular pistons 18 and 19 which separate the chamber 14 into three chamber sections.20, 21 and 22. The valve 11 includes a valve stem 23 which is secured to the piston assembly 17 for movement therewith. Alternatively the piston assembly 17 may be formed integrally with the valve stem 23. An inlet port 24 is provided in the wall of the housing 12 for the supply of hydraulic fluid to the chamber section 21.

The piston assembly 17 includes ports 25 and 26 provided in its annular shaft 28 to communicate with the respective chamber sections 20 and 21 and through the stem 23 with a longitudinally extending internal bore 29 formed within the shaft 28 or stem 23 of the valve 11. Supported for reciprocation within the bore 29 is a slide valve member 30 which includes spaced lands 32 and 33 separated by an annular groove 35 which define passageways for hydraulic fluid. Discharge ports 36 are provided at the upper end of the piston assembly 17 to communicate with the bore 29 whilst at the lower end of the bore 29 a spring 34 is provided to urge the valve member 30 to an upper position. The spring 34 which comprises a coil spring is disposed within the chamber section 22 about the stem 23 and extends between the piston 19 and head 13 to normally bias the piston assembly 17 upwardly.

The lower part of the housing 12 forms a drainage chamber 39 which vents through drainage ports 40. Further drainage ports 41 communicate with the bore 29 in the region of the spring 37 to vent this portion of the bore 29.

As an alternative to the spring 34 or in addition thereto, an external return spring 42 may be provided, the spring 42 acting between a flange 43 secured to the valve stem 23 and the end wall 15 of the housing 12 to normally bias the valve 11 to a closed position. Operation of the slide valve member 30 may be controlled by a solenoid 44 which has its armature connected to, or integral with the valve member 30, or alternatively a conventional rotational cam and cam shaft acting directly or indirectly on the valve member 30.

Figures 2, 3, 4, 5, 6:
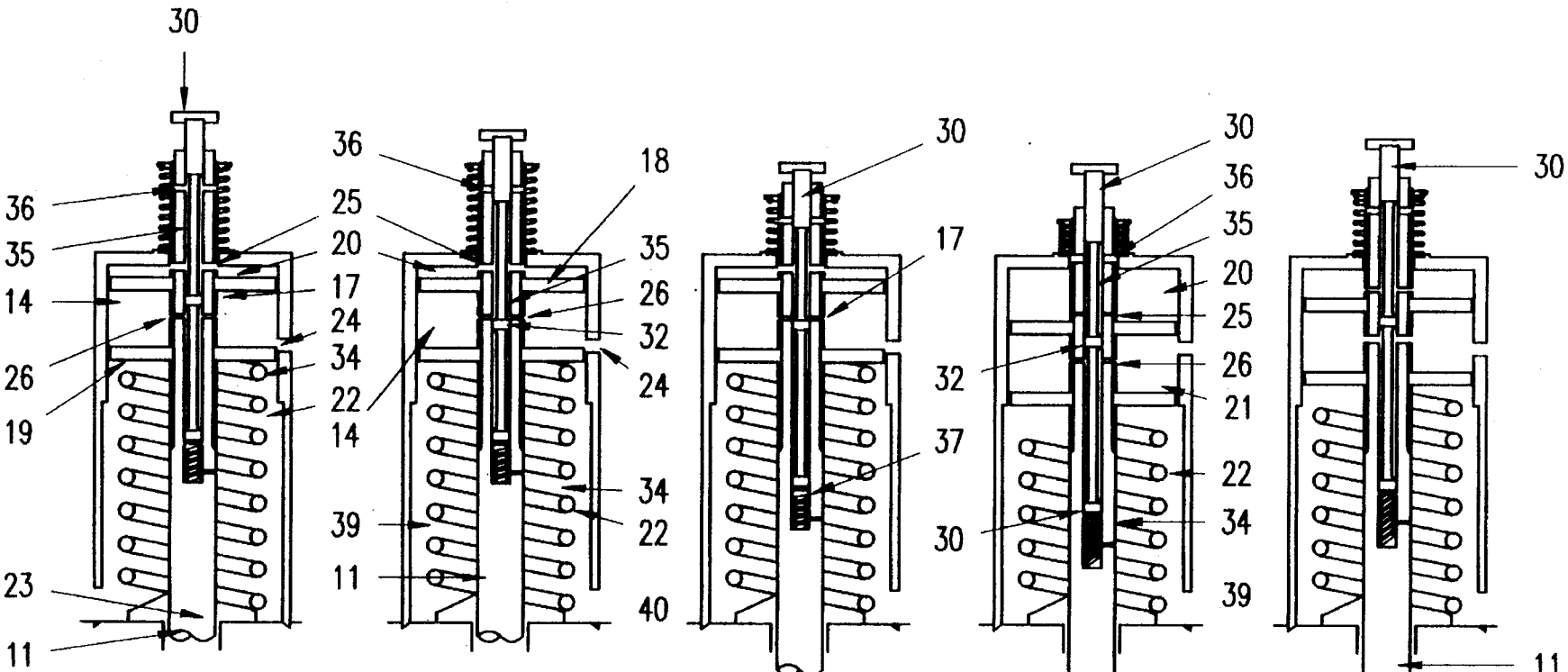
FIGS. 2 to 6 illustrate various stages of the operation of the actuator.

In use and as shown in FIGS. 2 to 6 the piston assembly 17 is moved to a raised position by the spring 34 and/or spring 42 so that the valve 11 is seated. In this position also the slide valve member 30 is held in a raised position. Fluid in the chamber section 20 communicates through the ports 25, annular groove 35 and ports 36 to drain. So as to open the valve 11, the slide valve member 30 is advanced by the solenoid 44 (or a cam) as shown initially in FIG. 3 so that fluid communication from the port 24 is opened through the ports 26, groove 35 and port 25 to the upper section 20 of the chamber 14, with the land 33 blocking its passage to the vent ports 36. The fluid in the chamber section 20 acting between the piston 18 and housing end wall 15 causes downward movement of the piston assembly 17 and thus opening movement of the valve 11. At the same time the slide valve member 30 is moved downwardly at the same rate by the solenoid 44 as shown in FIG. 4. It will be seen that during this motion the return spring 37 for the valve member 30 and returns springs 34 and 42 will be compressed.

When the valve 11 approaches a fully opened position, the valve member 30 is stopped in its movement as shown in FIG. 5 so that the land 32 blocks communication of the port 26 with the chamber section 20. The chamber section 20, however, is opened to vent through the ports 25, passage 35 and ports 36. The return springs 34 and 42 will thus cause the piston assembly 17 to raise upwardly thereby moving the valve 11 again towards a closed position. At the same time, the slide valve member 30 is also retracted as shown in FIG. 6 so that the valve 11 and slide valve member 30 move upwards at the same rate until the valve 11 is closed and the slide valve member 30 moved to the position of FIG. 2. The piston assembly 12 is thus slaved to reciprocating movement of the slide valve member 30.

The inlet port 24 is preferably fitted with a non-return valve so as to preclude the possibility of valve bounce in the event of engine overspeed or the operation of an engine with excessively low hydraulic pressure supply. In most cases, hydraulic fluid to the inlet port 24 is supplied as the existing lubrication oil in an engine pressurised by a conventional oil pump. To increase pressure in the hydraulic supply however, the normal oil pump may be replaced by a pump with increased capacity or an auxiliary pump may be provided for direct supply of fluid sometimes other than lubrication oil to the inlet port 24. The housing 12 for assembly and disassembly purposes is preferably formed into at least two parts separable or joinable at the position 12' by any connection arrangement known in the art.

Figure 7:
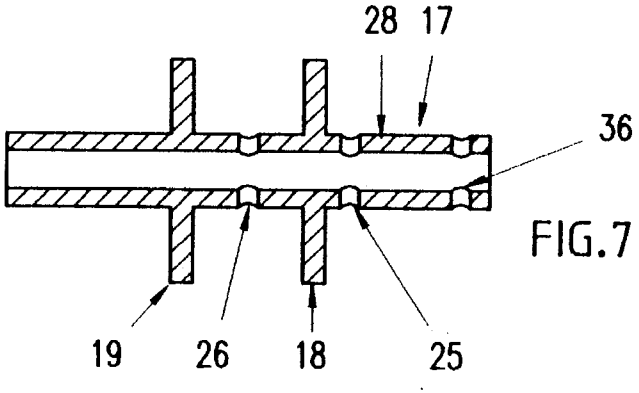
FIG. 7 is a sectional view showing one form of piston of the actuator.
Figure 8:
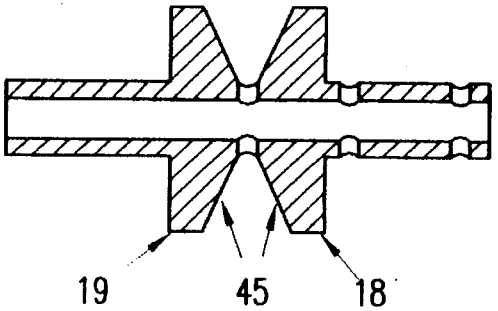
FIGS. 8 and 9 illustrate in sectional view further form of pistons for use in the actuator.

FIG. 7 illustrates in sectional view the preferred form of piston assembly 17 which comprises a component separate from the valve stem 23. The piston assembly 17 however may have the alternative form shown in FIG. 8 where the respective pistons 18 and 19 have frustoconical opposing faces 45 to facilitate the transfer of hydraulic fluid into the port 26.

Figure 9:
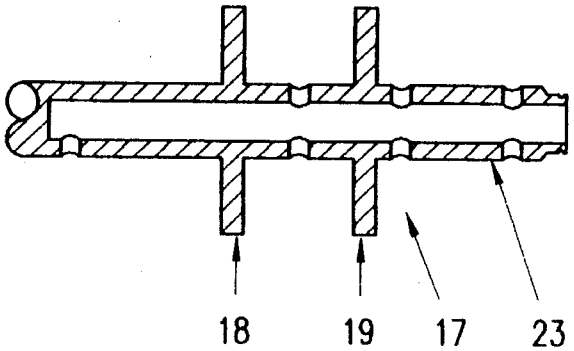

FIG. 9 illustrates in sectional view, a valve stem 23 having the piston assembly 17 and thus pistons 18 and 19 formed integrally therewith.

Figure 12:
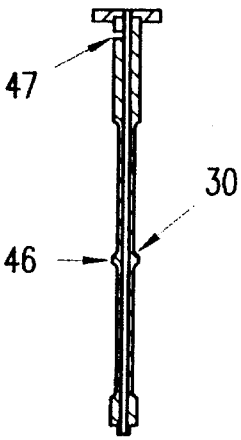
FIGS. 11 and 12 illustrate in elevational view preferred forms of slide valves for controlling the actuator.
Figure 11:
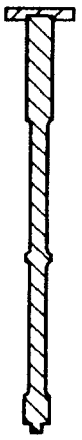
Figure 10:
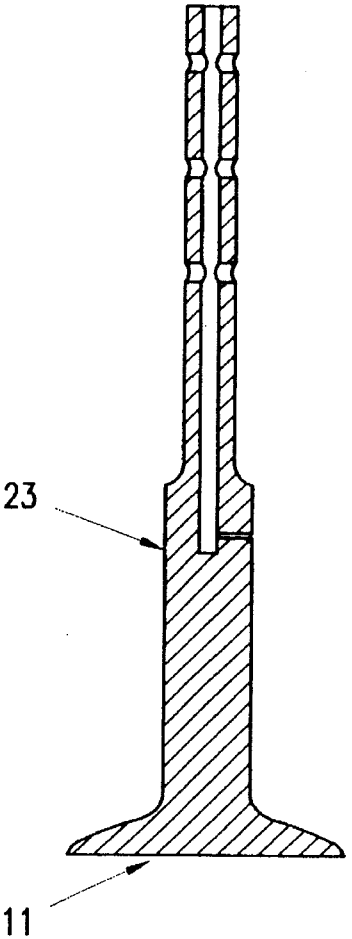
FIG. 10 is a longitudinal sectional view of an engine valve modified for use with the actuator of the present invention.

FIG. 10 illustrates the modified engine valve 11 formed in accordance with the present invention for use in association with the piston assembly 17 of FIG. 7 whilst the slide valve member 30 is suitably of the cross sectional form shown in FIG. 11. In the embodiment of FIG. 12 however, the valve member 30 includes a longitudinally extending bore 46 which extends through the end of the valve 30 or communicates with a radially extending port 47 to vent the portion of the bore 35 containing the spring 37. In this arrangement, of course, the vent port 41 may be eliminated.

Figure 13:
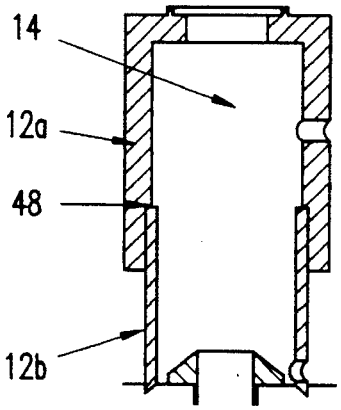
FIGS. 13 to 15 illustrate in sectional view alternate forms of housings for the actuator.
Figure 14:
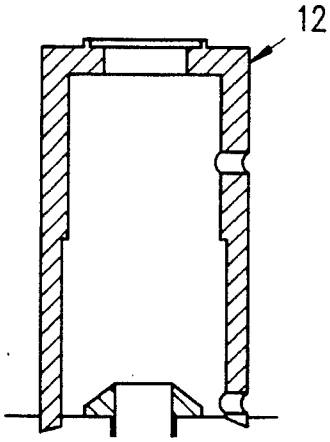
Figure 15:
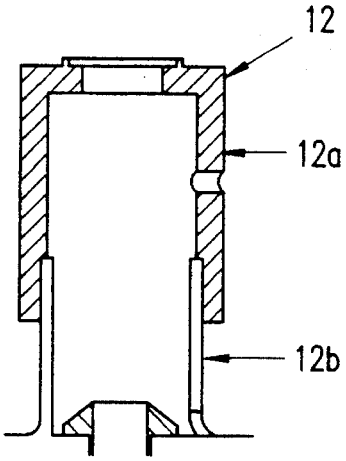

The housing 12 as shown in FIG. 1 may also be constructed in any of the forms shown in FIGS. 13 to 15. In FIG. 13, the housing 12 includes a top part 12a and a bottom part 12*b*, the part 12*a* having an internal shoulder 48 against which the part 12*b* abuts. Preferably the parts 12*a* and 12*b* are pressed and held together by any suitable mounting means or clamp securing the housing to the engine head 13. In FIG. 14, the housing 12 is in one part. In FIG. 15, the housing 12 is again in two parts 12*a* and 12*b* with the part formed integrally with the head 13.

Figure 16A:
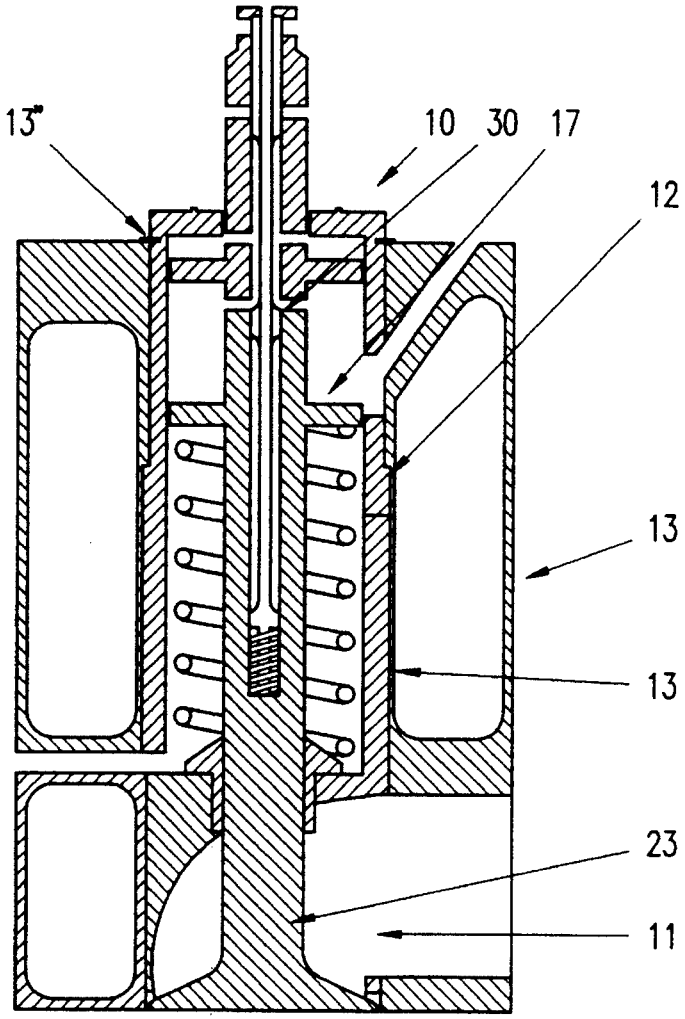
FIGS. 16A and 16B are sectional views showing alternative arrangements for mounting the actuator in the head of an engine.
Figure 16B:
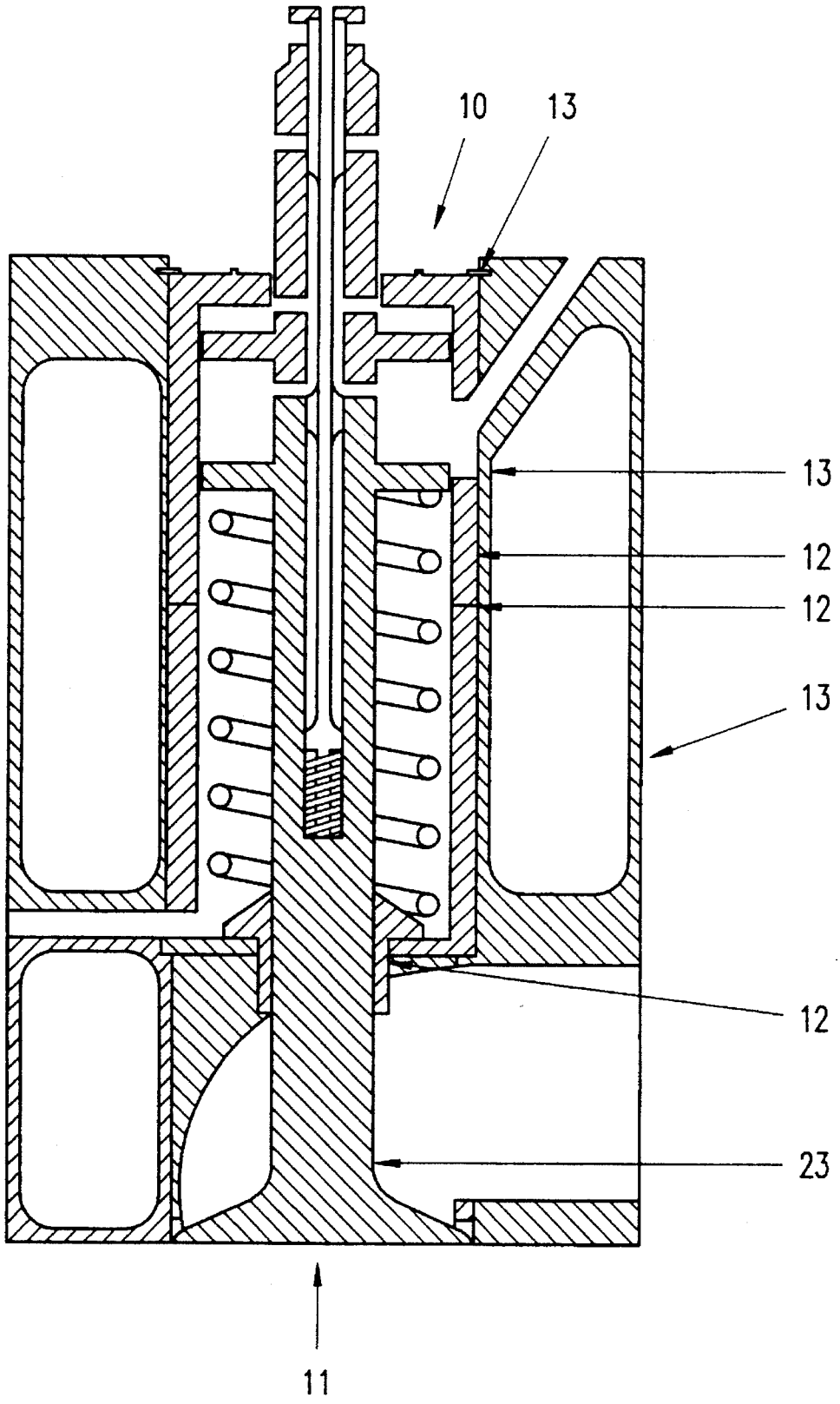
Figure 17:
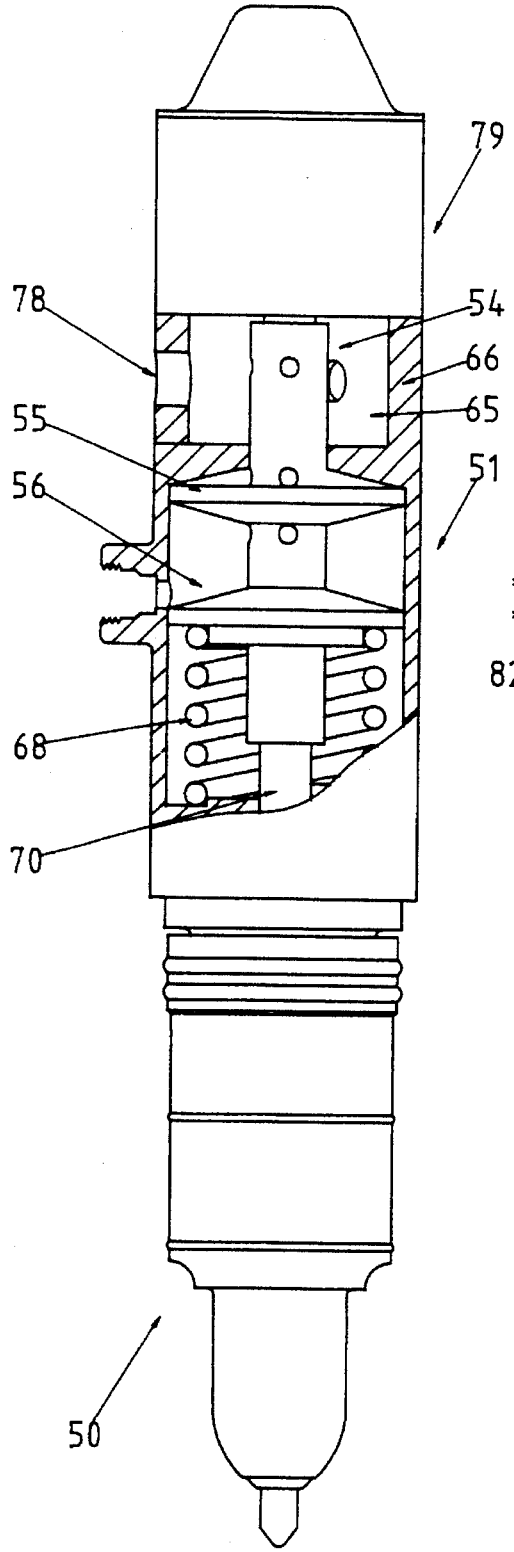
FIG. 17 illustrates in part cut-away view the application of the actuator of the invention to the control of a fuel injector.

In the embodiment of FIGS. 16A and 16B, the actuator 10 is arranged within the head 13 of a engine and like parts of the actuator of FIG. 1 have been given like numerals in FIGS. 16 and 17. The housing 12 in both instance may be split longitudinally to facilitate assembly and disassembly of the unit 10 and its placement within the head 13. In FIG. 16A, the housing 12 is placed into the head 13 from the lower side being located within a stepped bore 13' within the head 13 to mate therewith and be held in place by a circlip 13". In the arrangement of FIG. 16B, the housing 12 is inserted into the bore 13' from the top side of the head 13 to be again held in position by the circlip 13". In either case the housing 12 may be split as at 12' and 12" to facilitate assembly.

The timing of the opening and closing of the valve 11 may be simply controlled by varying the timing of operation of the solenoid 44 which can be microprocessor controlled. The above described arrangement also eliminates mechanical valve drive trains and permits infinitely variable valve timing and duration of lift. The arrangement also provides the possibility of decompressing individual cylinders or groups of cylinders so as to give lighter cranking loads during engine start up procedures. Simplified alteration of the valve timing also permits the starting of engines by direct air injection into a cylinder and the facilitating of an engine braking capacity. Overall, a simplified lighter engine with fewer wearing parts results.

Figure 18:
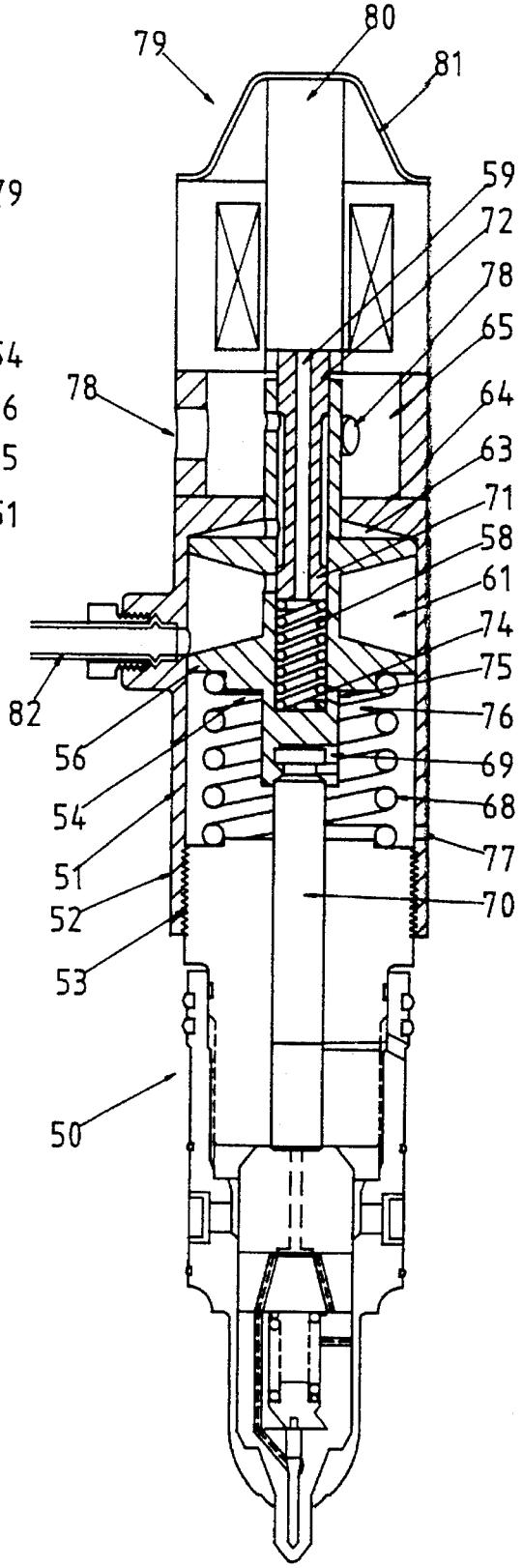
FIG. 18 is a longitudinal sectional view showing the actuator and fuel injector of FIG. 17.

Referring now to FIGS. 17 and 18 there is illustrated a fuel injector 50 which is arranged to be driven by a fluid actuator 51 according to the present invention which in this aspect is a single acting actuator. The actuator 51 includes a cylindrical chamber 52 which is mounted to the injector 50 through a connection 53 which may comprise a threaded or any other connection and which supports a reciprocating piston assembly 54. The piston assembly 54 includes a pair of spaced apart pistons 55 and 56 mounted on or formed integrally with a hollow sleeve 57 which defines a bore 58 for receiving a slide valve member 59. Ports 60 communicate the region between the pistons 55 and 56 which comprises a supply chamber 61 with the bore 58 whilst further ports 62 communicate the region above the piston 55 which comprises a working chamber 63 with the bore 58, the chamber 63 being defined between the piston 55 and an annular wall 64 extending transversely of the chamber 52. A vent chamber 65 is formed above the wall 64 being defined by an annular spacer 66 and further ports 67 formed in the sleeve 57 communicate the chamber 65 with the bore 58. A return spring 68 extends between the piston 56 and injector 50 to normally bias the piston assembly 54 to the raised attitude shown. The piston assembly 54 is also positively coupled at 69 to the plunger 70 of the injector 50.

The slide valve member 59 includes a pair of spaced lands 71 and 72 separated by an annular groove 73 and a return spring 74 located in the lower end of the bore 58 normally biases the slide valve member 59 upwardly to the position shown in FIG. 18. A bore 75 opening to the top of the assembly or optionally a vent 75' communicating with the bore 75 vents the lower end of the bore 58 (containing the spring 74) in the latter case to a lower chamber section 76 which contains the return spring 68 with that chamber itself being vented through ports 77. The upper vent chamber 65 is also vented through a port or ports 78 and the lower edges of each port 77 and 78 act as weirs so that operating fluid is always maintained in the respective chambers 65 and 76 for lubrication purposes. The slide valve member 59 is coupled to a double acting solenoid 79 which includes an armature 80 whose upward movement is restricted by a cap 81. Hydraulic fluid is supplied to the chamber section 61 through a supply port 82 which is connected to any suitable supply of hydraulic fluid.

In use and as shown in FIGS. 19 to 23 the return springs 74 and 68 initially maintain the slide valve member 59 and piston assembly 54 in a raised attitude and the injector plunger 70 retracted. Hydraulic fluid supplied through the supply port 82 of the chamber 61 is blocked from passage through ports 60 by the land 71, whilst the working chamber 63 is vented via the ports 62, groove 73 and ports 67.

Initial actuation of the solenoid 79 causes the slide valve member 59 to be advanced as shown in FIG. 20 so that the land 72 blocks the ports 67 whilst the land 71 opens the ports 60 so that fluid may pass from the supply chamber 61 through the groove 73, and ports 62 into the working chamber 63. This fluid working between the piston 55 and wall 64 causes the piston assembly 54 to be advanced against the force of the spring 68 as shown in FIG. 21 causing the injector plunger 70 to operate and apply a charge of fuel into an engine cylinder.

Reversing of the solenoid 79 will cause retraction of the slide valve 59 as shown in FIG. 22 so that the ports 60 are blocked thereby preventing further fluid passing into the working chamber 63 whilst chamber 63 is vented via the ports 62, groove 73 and ports 67. The compressed spring 68 will thus cause the piston assembly 54 to retract as shown in FIG. 23.

The stroke of the plunger 70 is thus governed by the extent of movement of the armature 80 of the solenoid 79 so that the amount of fuel supplied by the injector on each stroke can be selectively varied and its rate of injection controlled by varying the power supplied to the solenoid. Alternatively, the plunger 70 of the injector may be operated at its full stroke at all times and the fuel metered by a spill port under the control of a solenoid operated valve ducted from the injector high pressure fuel chamber.

Application of the actuator of the invention to the control of fuel injectors has a number of advantages permitting individual control of the injectors during engine operation giving more even power development by the engine and also permitting variable injection pressures to suit different fuels and different environmental conditions. Individual injectors may be isolated for reduced power operations and infinitely variable injection timing is possible using microprocessor controls.

Both valve and injector assemblies as described above may be combined in an engine giving a much simpler two or four stroke engine due to the elimination of many parts. Such an engine may be readily controlled for direct reversing to suit various situations.

The present invention thus provides a fluid actuator which has many applications and which is particularly suited to use in controlling various functions at motor vehicles. Movement of the slide valve member in opposite directions causes corresponding slaved movement of the piston assembly so that the actuator of the present invention is particularly suited to servomechanism type applications.

Many modifications and variations to the invention as would be apparent to persons skilled in the art may be made thereto without departing from the broad scope and ambit thereof as herein set forth. For example, different valving configurations may be employed other than the slide valve arrangement illustrated. Furthermore, whilst the actuator of the invention is primarily suited to be driven by liquid such as hydraulic fluid, it may readily be adapted to be driven by gases or air.

I claim:

1. A fluid actuated engine valve assembly comprising:

an engine valve having an elongated valve stem, and a fluid actuator for actuating said engine valve, said fluid actuator including a chamber, said valve stem extending into said chamber, first and second spaced apart pistons fixed for movement with said valve stem and dividing said chamber into a first chamber section between said first piston and an end of said chamber and a second chamber section between said first and second pistons, passageway means communicating with said first and second chamber sections, said passageway means including a passage extending longitudinally of, and within said valve stem, fluid inlet means communicating with said second chamber section, and slide valve means within said passage for controlling the flow of fluid through said passageway means, said valve means being operable to communicate fluid through said passageway means from said second to said first chamber section so as to cause movement of said valve stem in a first direction to open said engine valve, biasing means for opposing movement of said valve stem in said first direction, and said valve means being further operable to vent fluid from said first chamber section whereby to permit said biasing means to move said valve stem in a direction opposite said first direction to close said engine valve.

2. A fluid actuated engine valve assembly according to claim 1 and including first and second port means communicating with said first and second chamber sections respectively and wherein said valve means controls communication between said port means and said passage (passageway means).

3. A fluid actuated engine valve assembly according to claim 2 wherein said valve stem includes an end portion extending beyond said end of said chamber, vent port means in said end portion and adapted for communication with said passage, said valve means being adapted to control communication of said vent port means with said first port means whereby to control venting of said first chamber section.

4. A fluid actuated engine valve assembly according to claim 1 wherein said first and second pistons are defined by a piston assembly mounted to said valve stem.

5. A fluid actuated engine valve assembly according to claim 1 wherein said valve means includes a plurality of lands.

6. A fluid actuated engine valve assembly according to claim 5 wherein said lands are separated by annular grooves defining fluid paths in said passage.

7. A fluid actuated engine valve assembly according to claim 3 wherein movement of said valve means in one direction opens communication between said first and second port means via said passage to cause said movement of said valve stem in said first direction.

8. A fluid actuated engine valve assembly according to claim 7 wherein movement of said valve means in a direction opposite said one direction opens communication between said first port means and vent port means via said passage to permit movement of said valve stem in said opposite direction under the influence of said biasing means.

9. A fluid actuated engine valve assembly according to claim 1 wherein actuation of said valve means is controlled by a solenoid.

10. A fluid actuated engine valve assembly according to claim 1 wherein said biasing means acts on said second piston.

11. A fluid actuated engine valve assembly according to claim 10 wherein said biasing means comprising spring means disposed between said second piston and an end of said chamber remote from said first chamber section.

12. A fluid actuated engine valve assembly according to claim 1 wherein said biasing means is arranged externally of said chamber.

13. A fluid actuated engine valve assembly according to claim 12 wherein said biasing means comprises a spring.

14. A fluid actuated engine valve assembly according to claim 4 wherein said piston assembly includes a hollow shaft, said valve stem extending into said hollow shaft.

15. A fluid actuated engine valve assembly according to claim 14 and including ports communicating said first and second chamber sections with said passage, said ports extending through said hollow shaft and said valve stem.

16. A fluid actuated engine valve assembly comprising:

an engine valve having an elongated valve stem, and a fluid actuator for actuating said engine valve, said fluid actuator including a chamber, said valve stem extending through said chamber, first and second spaced apart pistons fixed for movement with said valve stem and dividing said chamber into a first chamber section between said first piston and an end of said chamber and a second chamber section between said first and second pistons, a passageway extending longitudinally of and within said valve stem, fluid inlet means communicating with said second chamber section, and a valve member within said passageway for controlling flow of fluid through said passageway, said valve member being moveable longitudinally of said passageway to communicate fluid through said passageway from said second to said first chamber section so as to cause movement of said valve stem in a first direction to open said engine valve, biasing means for opposing movement of said valve stem in said first direction, and said valve member being further moveable to vent fluid from said first chamber section through said passageway whereby to permit said biasing means to move said valve stem in a direction opposite said first direction to close said engine valve.

* * * * *